US010806972B1

(12) United States Patent
Lin

(10) Patent No.: US 10,806,972 B1
(45) Date of Patent: Oct. 20, 2020

(54) BALL WITH SENSOR

(71) Applicant: Yi Ching Lin, Kaohsiung (TW)

(72) Inventor: Yi Ching Lin, Kaohsiung (TW)

( * ) Notice: Subject to any disclaimer, the term of this patent is extended or adjusted under 35 U.S.C. 154(b) by 0 days.

(21) Appl. No.: 16/693,215

(22) Filed: Nov. 22, 2019

(30) Foreign Application Priority Data

Sep. 23, 2019 (TW) ..... 108212518 U

(51) Int. Cl.
*A63B 43/00* (2006.01)
*A63B 41/00* (2006.01)

(52) U.S. Cl.
CPC ..... *A63B 43/004* (2013.01); *A63B 41/00* (2013.01); *A63B 2209/00* (2013.01); *A63B 2220/833* (2013.01)

(58) Field of Classification Search
CPC ..... A63B 41/00; A63B 2209/00; A63B 43/06; A63B 43/004; A63B 2220/833
See application file for complete search history.

(56) References Cited

U.S. PATENT DOCUMENTS 3,709,491 A * 1/1973 Minchin ..... A63B 43/007 473/575
5,725,445 A * 3/1998 Kennedy ..... A63B 43/06 473/570
6,251,035 B1 * 6/2001 Fa ..... A63B 41/00 473/570
6,537,125 B1 * 3/2003 Motosko, III ..... A63B 43/04 446/220
7,614,959 B1 * 11/2009 Gentile ..... A63B 24/0021 463/30
10,523,053 B2 * 12/2019 Munson ..... H02J 7/00034
2003/0224885 A1 * 12/2003 Leal ..... A63B 43/06 473/570
2005/0288134 A1 * 12/2005 Smith ..... A63B 71/0605 473/570
2006/0063622 A1 * 3/2006 Nurnberg ..... A63B 43/007 473/604
2008/0274844 A1 * 11/2008 Ward ..... A63B 43/00 473/570

(Continued)

FOREIGN PATENT DOCUMENTS

EP 2353666 A1 * 8/2011 ..... A63B 41/02
FR 3010910 A1 * 3/2015 ..... A63B 67/14
WO WO-2008080626 A1 * 7/2008 ..... A63B 41/08

*Primary Examiner* — Steven B Wong
(74) *Attorney, Agent, or Firm* — Hershkovitz & Associates, PLLC; Abe Hershkovitz

(57) ABSTRACT

A ball has a hollow ball, a sensor, and a sensor assembling structure. The hollow ball is hollow, is inflatable, and has an inner peripheral surface. The sensor is disposed at a central position inside the hollow ball. The sensor assembling structure has an installation assembly and a thermal insulation coat. The installation assembly has multiple connecting members. Each one of the multiple connecting members is made of a thermal insulation material and is connected to the inner peripheral surface of the hollow ball. The thermal insulation coat is connected to the multiple connecting members and is wrapped around the sensor for thermally insulating the sensor. The sensor assembling structure retains the sensor at the central position inside the hollow ball for collecting data and improving efficiency during training of athletes.

6 Claims, 5 Drawing Sheets

(56) References Cited

U.S. PATENT DOCUMENTS

| | | | | |
|---|---|---|---|---|
| 2009/0111619 | A1* | 4/2009 | Kobayashi | A63B 43/06 473/569 |
| 2010/0069181 | A1* | 3/2010 | Lin | A63B 43/06 473/570 |
| 2010/0130314 | A1* | 5/2010 | Von Der Gruen | A63B 63/00 473/570 |
| 2011/0077112 | A1* | 3/2011 | Erario | A63B 41/02 473/570 |
| 2011/0118062 | A1* | 5/2011 | Krysiak | A63B 41/02 473/570 |
| 2014/0194232 | A1* | 7/2014 | Krysiak | A63B 47/00 473/570 |
| 2015/0182810 | A1* | 7/2015 | Thurman | A63B 41/02 473/570 |
| 2015/0224369 | A1* | 8/2015 | Ahn | A63B 71/0622 473/570 |
| 2016/0107046 | A1* | 4/2016 | Krysiak | A63B 71/0622 473/605 |
| 2017/0246513 | A1* | 8/2017 | Fang | A63B 43/004 |
| 2018/0147455 | A1* | 5/2018 | Lee | H02J 7/0042 |
| 2018/0154222 | A1* | 6/2018 | Thurman | A63B 41/02 |
| 2018/0200582 | A1* | 7/2018 | Thurman | A63B 43/002 |
| 2018/0200583 | A1* | 7/2018 | Thurman | A63B 43/002 |

* cited by examiner

BALL WITH SENSOR

BACKGROUND OF THE INVENTION

1. Field of the Invention

The present invention relates to a ball with a sensor, and more particularly to a ball with a hollow ball and a sensor disposed at a central position inside the hollow ball.

2. Description of Related Art

In order to detect pitching velocities or contact points during baseball drills, a coach has to stand close to a pitcher or a hitter and to hold a detecting device to collect data of pitching velocities or contact points. The coach standing next to the pitcher or the hitter is subject to risk of being hit by a flying baseball and getting hurt.

For avoiding injuring the coach, a baseball with detecting function has been invented and is commercially available. The baseball is equipped with a sensor disposed within the baseball. The sensor is linked to a mobile device prior to a baseball drill. Therefore, the sensor can collect data and transmit the collected data to the mobile device. The baseball with detecting function lowers the risk of injuring the coach.

The baseball is solid inside, so the sensor can be easily embedded at a central position inside the baseball without altering the position of the center of mass of the baseball. However, a hollow athletic ball such as a basketball, a volleyball, or a soccer ball has a bladder and is inflatable. The sensor is difficult to be located at a central position inside the hollow athletic ball without altering the position of the center of mass of the hollow athletic ball and changing the flying path of the hollow athletic ball. Moreover, the bladder of the hollow athletic ball has to be thermally treated during manufacturing. The heat provided by a thermal treatment may damage the sensor inside the hollow athletic ball.

Therefore, to maintain the sensor disposed at the central position of the hollow athletic ball and to prevent the sensor from being damaged by heat generated by thermal treatment, the manufacturers of athletic balls have endeavored to seek improvement of means for assembling the sensor inside the hollow athletic ball.

To improve the conventional hollow athletic ball with a sensor, the present invention provides a ball with a sensor to mitigate or obviate the aforementioned problems.

SUMMARY OF THE INVENTION

The main objective of the present invention is to provide a ball with a sensor that keeps the sensor disposed at a central position inside the ball and keeps the sensor from being damaged by heat generated by thermal treatment.

The ball with a sensor comprises a hollow ball, a sensor, and a sensor assembling structure. The hollow ball is hollow, is inflatable, and has an inner peripheral surface. The sensor is disposed at a central position inside the hollow ball. The sensor assembling structure has an installation assembly and a thermal insulation coat. The installation assembly has multiple connecting members. Each one of the multiple connecting members is made of a thermal insulation material and is connected to the inner peripheral surface of the hollow ball. The thermal insulation coat is connected to the multiple connecting members and is wrapped around the sensor for thermally insulating the sensor. The sensor assembling structure retains the sensor at the central position inside the hollow ball for collecting data and improving efficiency during training of athletes.

Other objects, advantages, and novel features of the invention will become more apparent from the following detailed description when taken in conjunction with the accompanying drawings.

DETAILED DESCRIPTION OF PREFERRED EMBODIMENTS

Figure 1:
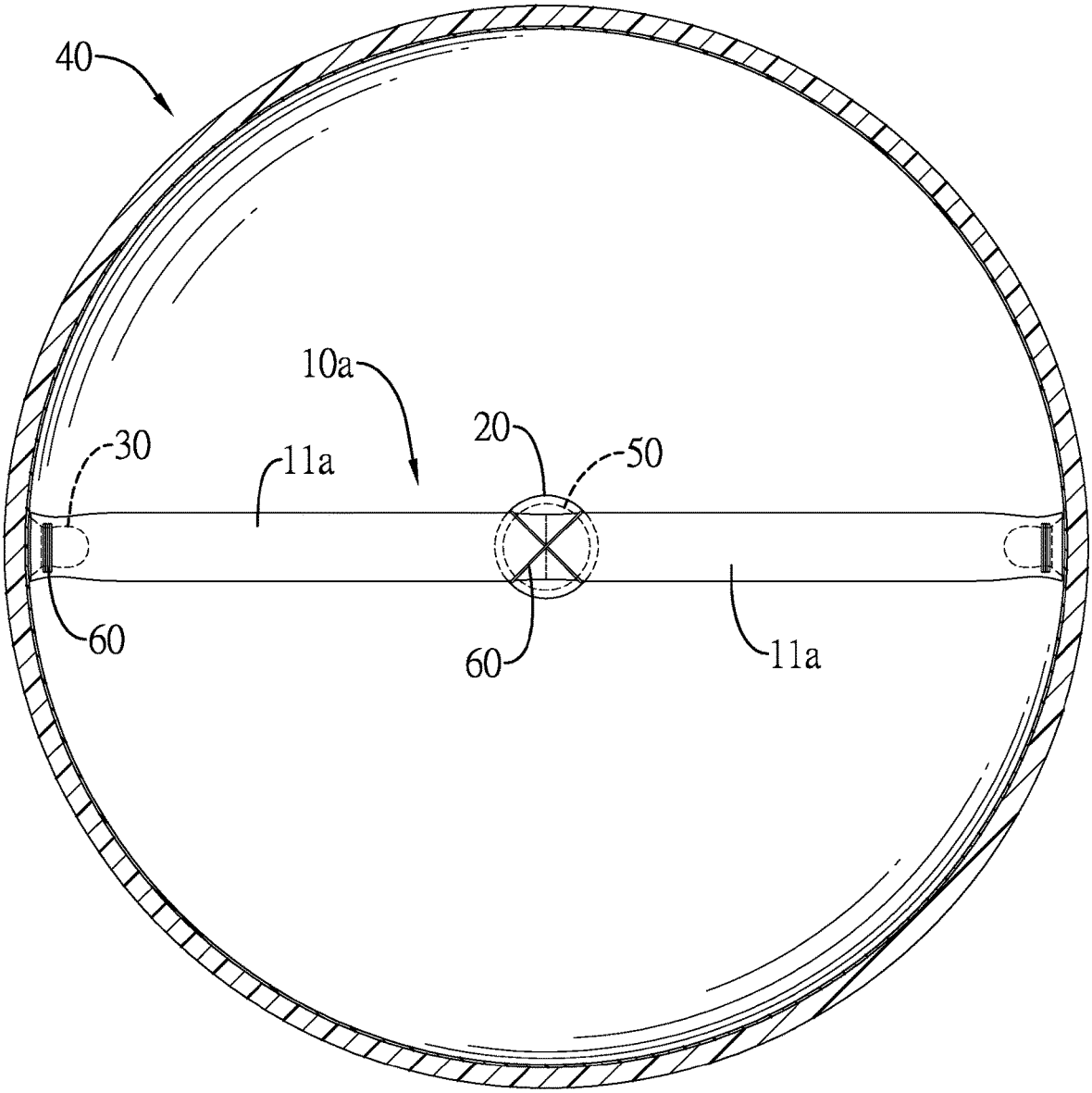
FIG. 1 is a side view in partial section of a first embodiment of a ball with a sensor in accordance with the present invention.
Figure 2:
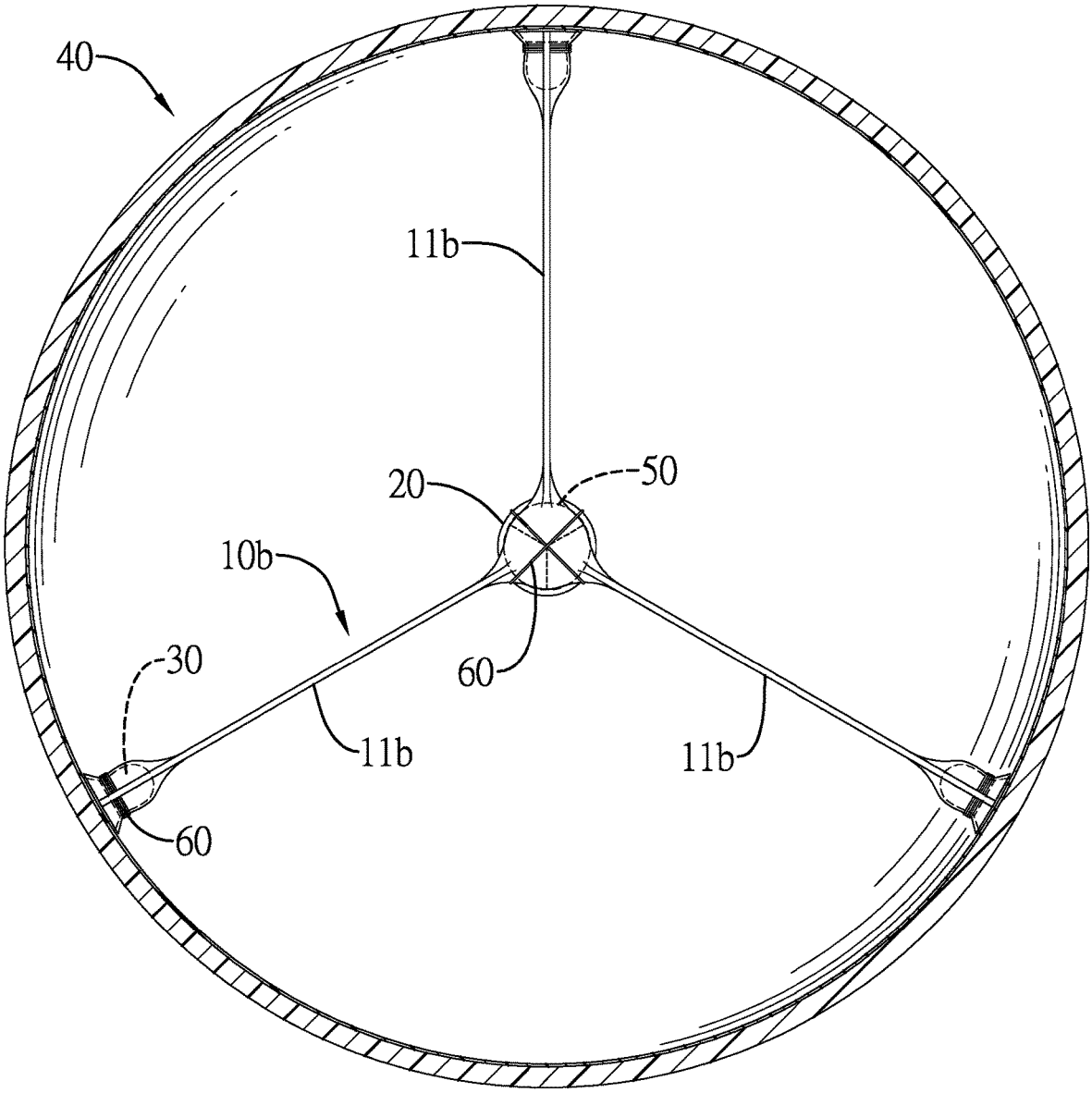
FIG. 2 is a side view in partial section of a second embodiment of a ball with a sensor in accordance with the present invention.
Figure 3:
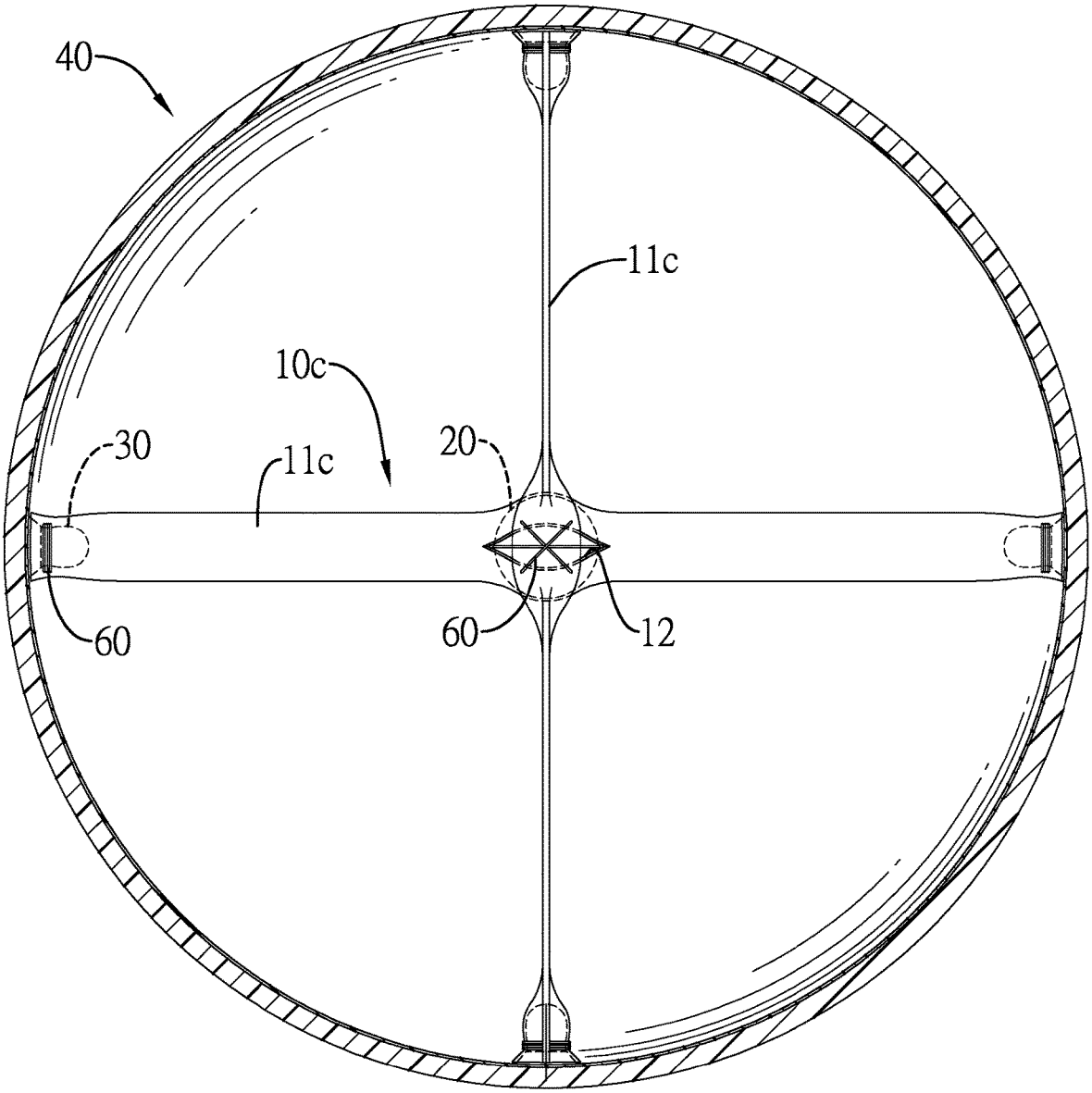
FIG. 3 is a side view in partial section of a third embodiment of a ball with a sensor in accordance with the present invention.

With reference to FIGS. 1 to 3, embodiments of a ball in accordance with the present invention each has a sensor assembling structure with an installation assembly 10*a*, 10*b*, 10*c* and a thermal insulation coat 20, multiple fastening joints 30, a hollow ball 40, and a sensor 50.

With reference to FIG. 1, the hollow ball 40 is a hollow sphere, is inflatable, and has an inner peripheral surface. In the first embodiment of the present invention, the thermal insulation coat 20 is a shell and has an outer peripheral surface. The thermal insulation coat 20 is made of a thermal insulation material such as glass fiber or polytetrafluoroethylene, PTFE, and is able to keep the heat out and thermally insulate the sensor. The thermal insulation coat 20 is disposed at a central position inside the hollow ball 40. The sensor 50 is disposed within the thermal insulation coat 20, is wrapped around by the thermal insulation coat 20, and is disposed at the central position inside the hollow ball 40. In the first embodiment, the thermal insulation coat 20 is a shell made of a thermal insulation material. Practically, the thermal insulation coat 20 may be a layer of thermal insulation material coated on the sensor 50. The sensor 50 can be a device that is designed for measuring speeds, detecting vibrations, etc.

The installation assembly 10*a* is disposed within the hollow ball 40 and has two connecting members 11*a*. Each connecting member 11*a* is also made of a thermal insulation material such as glass fiber or polytetrafluoroethylene. Each connecting member 11*a* is hollow and elongated. Each connecting member 11*a* has a middle section being flat and a first end and a second end opposite each other. The first end of each connecting member 11*a* is connected to the outer peripheral surface of the thermal insulation coat 20. The second end of each connecting member 11*a* is connected to the inner peripheral surface of the hollow ball 40. The two connecting members 11*a* are in alignment with each other. More specifically, in the first embodiment, the multiple fastening joints 30 are two fastening joints 30 protruding from the inner peripheral surface of the hollow ball 40. The second ends of the two connecting members 11*a* are respectively mounted around the two fastening joints 30 and are tightened by threads 60 mounted through the second ends to be respectively fixed to the two fastening joints 30. The second ends of the two connecting members 11*a* are connected to the inner peripheral surface of the hollow ball 40 via the two fastening joints 30, respectively.

With reference to FIG. 2, the second embodiment is similar to the first embodiment. In the second embodiment, the installation assembly 10*b* has three connecting members 11*b*. Each connecting member 11*b* is hollow and elongated. Each connecting member 11*b* has a middle section being flat and a first end and a second end opposite each other. The multiple fastening joints 30 are three fastening joints 30 accordingly. The first end of each connecting member 11*b* is connected to the outer peripheral surface of the thermal insulation coat 20. The second end of each connecting member 11*b* is mounted around a corresponding one of the three fastening joints 30 and is tightened by threads 60.

Figure 4:
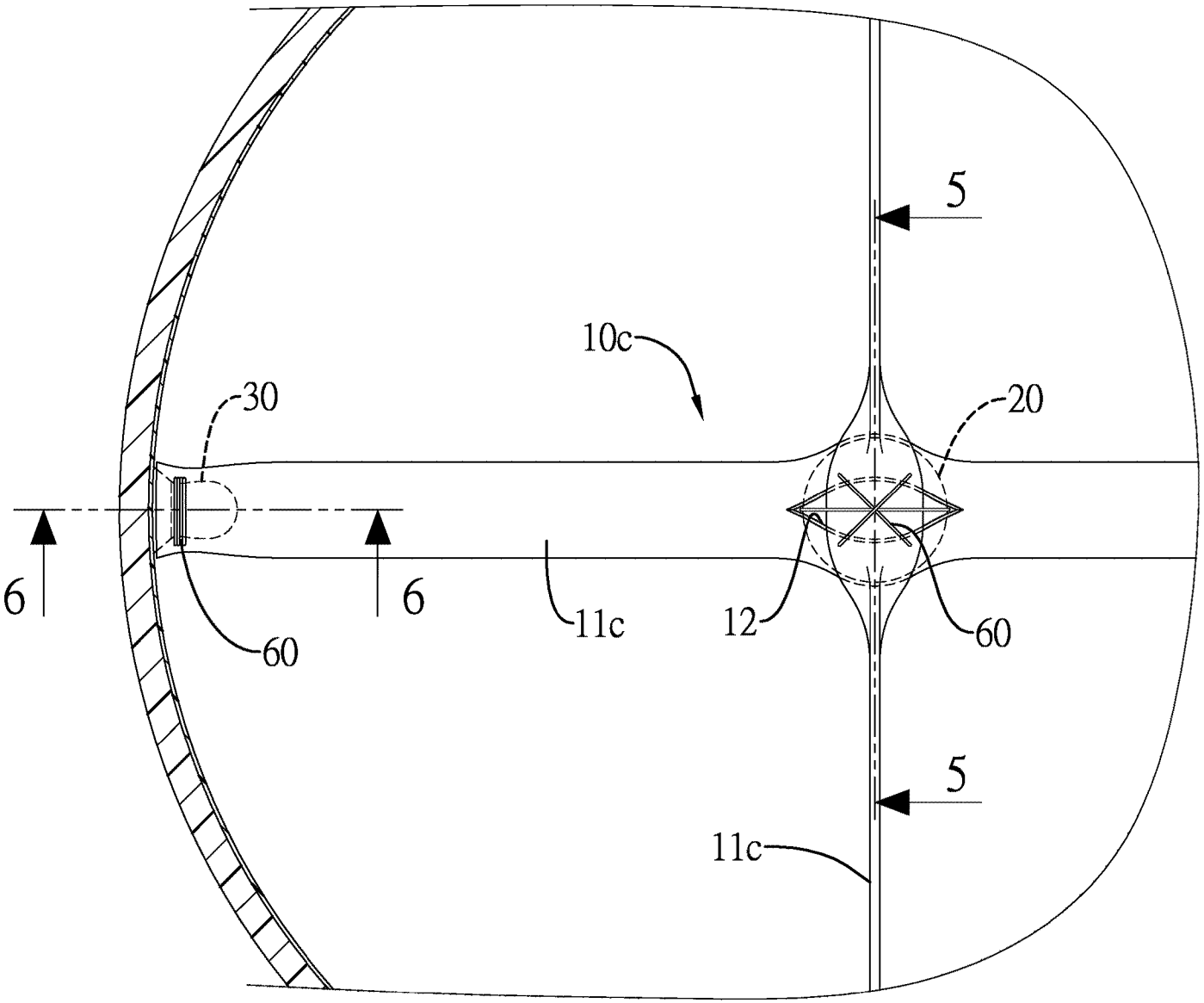
FIG. 4 is a partially enlarged side view in partial section of the ball in FIG. 3.
Figure 5:
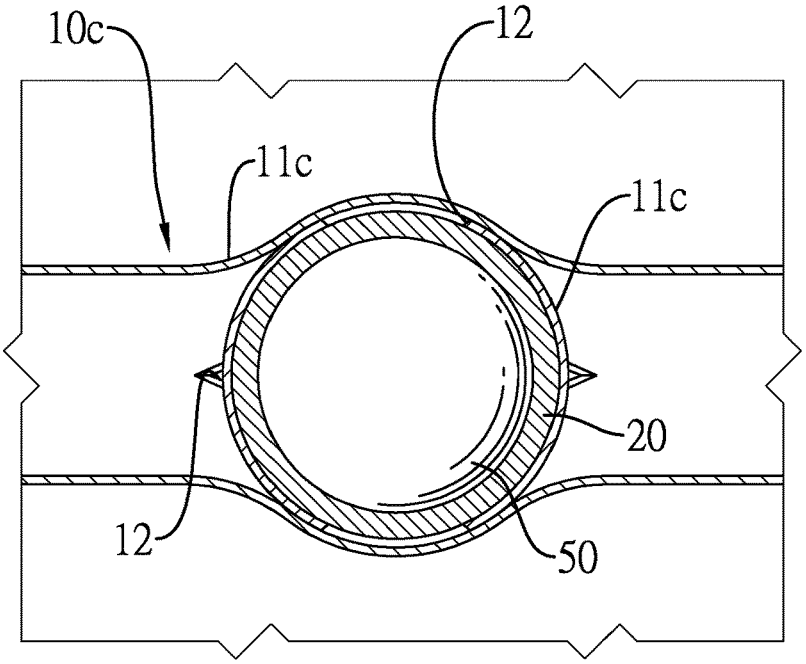
FIG. 5 is a partially enlarged cross sectional side view of the ball along line 5-5 in FIG. 4.
Figure 6:
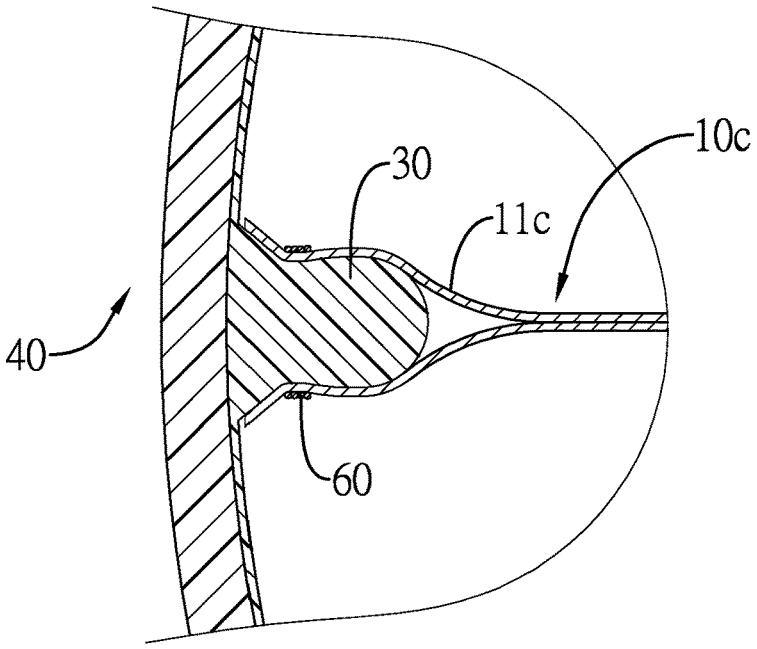
FIG. 6 is a partially enlarged cross sectional side view of the ball along line 6-6 in FIG. 4.

With reference to FIGS. 3 to 5, the third embodiment is similar to the first and the second embodiments. In the third embodiment, the installation assembly 10*c* has two connecting members 11*c*. Each connecting member 11*c* is hollow and elongated. Each connecting member 11*c* has a middle section being flat and a first end and a second end opposite each other. The first end and the second end of each connecting member 11*c* are both connected to the inner peripheral surface of the hollow ball 40 via the multiple fastening joints 30. Each connecting member 11*c* has an inserting hole 12 defined through a middle section of the connecting member 11*c* for the other one of the two connecting members 11*c* to be mounted through. The middle sections of the two connecting members 11*c* are intersected with each other accordingly. The thermal insulation coat 20 and the sensor 50 therein are disposed within one of the two connecting members 11*c*. The middle sections of the two connecting members 11*c* are tightened by threads 60 mounted through the middle sections to keep the sensor 50 and the thermal insulation coat 20 disposed at the central position inside the hollow ball 40. The threads 60 may be made of materials with or without elasticity.

The installation assemblies 11*a*, 11*b*, 11*c* can be applied to hollow balls such as basketballs, volleyballs, soccer balls, and so on. The hollow balls are not restricted to athletic balls. Amounts and lengths of the connecting members 11*a*, 11*b*, 11*c* can be adjusted according to specifications and pounds per square inch (PSI) of the hollow balls.

Furthermore, the connecting members 11*a*, 11*b*, 11*c* of the installation assembly 10*a*, 10*b*, 10*c* and the thermal insulation coat 20 are made of a thermal insulation material and can withstand heat generated by thermal treatment during manufacturing to prevent the sensor 50 from being damaged by the heat.

With reference to FIGS. 1 to 3, when the hollow ball 40 is inflated, tensions provided by the connecting members 11*a*, 11*b*, 11*c* keep the thermal insulation coat 20 and the sensor 50 therein at the central position of the hollow ball 40 without altering a center of mass of the hollow ball 40. Flying paths of the hollow ball 40 would not be affected by the sensor 50 inside the hollow ball 40. The sensor 50 can be linked to a mobile device of an athlete to transmit collected data to the mobile device. The athlete can improve posture according to the data collected by the sensor 50 to promote efficiency of drills.

In conclusion of the above, the sensor assembling structure in accordance with the present invention keeps the thermal insulation coat 20 at the central position inside the inflated hollow ball 40 via the installation assemblies 10*a*, 10*b*, 10*c* connected to the inner peripheral surface of the hollow ball 40. The sensor assembling structure in accordance with the present invention avoids shifting of the center of mass of the hollow ball 40 and provides the athlete with data collected from the sensor 50 within the hollow ball 40 to promote training effects.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A ball comprising:

a hollow ball being hollow, being inflatable, and having an inner peripheral surface;

a sensor disposed at a central position inside the hollow ball; and a sensor assembling structure having an installation assembly having multiple connecting members;

each one of the multiple connecting members made of a thermal insulation material, being elongated, and having a first end and a second end opposite the first end of the connecting member, and the second ends of the multiple connecting members connected to the inner peripheral surface of the hollow ball; and a thermal insulation coat connected to the first end of each one of the multiple connecting members and wrapped around the sensor for thermally insulating the sensor; and multiple fastening joints protruding from the inner peripheral surface of the hollow ball, and respectively attached to the second ends of the multiple connecting members;

wherein the second ends of the multiple connecting members are respectively mounted around the multiple fastening joints and are tightened by threads.

2. The ball as claimed in claim 1, wherein the thermal insulation coat is made of glass fiber.

3. A ball comprising:

a hollow ball being hollow, being inflatable, and having an inner peripheral surface;

a sensor disposed at a central position inside the hollow ball; and a sensor assembling structure having an installation assembly having multiple connecting members;

each one of the multiple connecting members made of a thermal insulation material, being elongated, and having a middle section and two opposite ends connected to the inner peripheral surface of the hollow ball; and the middle sections of the multiple connecting members intersected with each other; and a thermal insulation coat connected to the multiple connecting members and wrapped around the sensor for thermally insulating the sensor; and multiple fastening joints protruding from the inner peripheral surface of the hollow ball;

the two opposite ends of each one of the multiple connecting members respectively mounted to two corresponding ones of the multiple fastening joints and connected to the inner peripheral surface of the hollow ball via the two corresponding fastening joints, wherein the two opposite ends of each one of the multiple connecting members are respectively mounted around two corresponding ones of the multiple fastening joints and are respectively tightened by threads.

4. The ball as claimed in claim 3, wherein the thermal insulation coat is made of polytetrafluoroethylene.

5. The ball as claimed in claim 3, wherein each one of the multiple connecting members has an inserting hole defined through the middle section of the connecting member for the other connecting members to be mounted through.

6. The ball as claimed in claim 3, wherein the sensor and the thermal insulation coat wrapped around the sensor are disposed within one of the multiple connecting members; and the middle sections of the multiple connecting members are tightened by threads to keep the sensor and the thermal insulation coat disposed at the central position inside the hollow ball.

* * * * *